US006626320B2

(12) United States Patent
Berg, Sr.

(10) Patent No.: US 6,626,320 B2
(45) Date of Patent: Sep. 30, 2003

(54) DOUBLE WALLED UNDERGROUND STORAGE TANK AND METHOD FOR MAKING THE SAME

(75) Inventor: Robin L. Berg, Sr., Hudson, WI (US)

(73) Assignee: Xerkes Corporation, Minneapolis, MN (US)

( * ) Notice: Subject to any disclaimer, the term of this patent is extended or adjusted under 35 U.S.C. 154(b) by 0 days.

(21) Appl. No.: 09/864,153

(22) Filed: May 25, 2001

(65) Prior Publication Data

US 2002/0175167 A1 Nov. 28, 2002

(51) Int. Cl.[7] ..... B65D 90/24
(52) U.S. Cl. ..... 220/567.1; 220/654
(58) Field of Search ..... 220/565, 567.1, 220/567.2, 560.03, 586, 588, 589, 646, 648, 654, 4.13

(56) References Cited

U.S. PATENT DOCUMENTS

| | | | | |
|---|---|---|---|---|
| 4,739,659 | A | | 4/1988 | Sharp |
| 4,781,777 | A | | 11/1988 | Pugnale et al. |
| 4,871,078 | A | | 10/1989 | Sharp |
| 4,875,361 | A | | 10/1989 | Sharp |
| 4,925,046 | A | | 5/1990 | Sharp |
| 4,948,007 | A | | 8/1990 | Berg et al. |
| 4,958,957 | A | | 9/1990 | Berg et al. |
| 4,974,739 | A | | 12/1990 | Gelin |
| 4,989,447 | A | | 2/1991 | Gelin |
| 5,017,044 | A | | 5/1991 | Sharp |
| 5,020,358 | A | | 6/1991 | Sharp |
| 5,158,201 | A | | 10/1992 | Bartlow |
| 5,220,823 | A | | 6/1993 | Berg et al. |
| 5,224,621 | A | | 7/1993 | Cannan, Jr. et al. |
| 5,259,895 | A | * | 11/1993 | Sharp ..... 156/172 |
| 5,544,974 | A | | 8/1996 | Berg et al. |
| 5,720,404 | A | | 2/1998 | Berg et al. |
| 5,799,817 | A | * | 9/1998 | Sharp ..... 220/567.1 |
| 5,803,304 | A | | 9/1998 | Berg |
| 6,167,608 | B1 | | 1/2001 | Burwell et al. |
| 6,280,614 | B1 | | 8/2001 | Berg et al. |

* cited by examiner

*Primary Examiner*—Stephen Castellano
(74) *Attorney, Agent, or Firm*—Piper Rudnick LLP; Steven B. Kelber

(57) ABSTRACT

An underground storage tank includes an outer wall having integrally formed ribs, the ribs being closed off by a layer of material applied directly over the space defined created by the ribs and attached to the outer wall, a layer of plastic film or other annular material through which liquid may flow placed over portions of the outer wall between the ribs and extending past the shoulders of the ribs but not extending completely over the material covering the opening of the rib, and an inner wall formed over the annular material and attached to the portion of the material covering the opening provided by the rib that is not covered by the annular material. In this way, the inner wall is tied and preferably chemically and mechanically bonded to the outer wall through the material covering the opening of the rib.

18 Claims, 4 Drawing Sheets

SECTION A - A

SECTION A – A

SECTION B – B

SECTION C – C

DOUBLE WALLED UNDERGROUND STORAGE TANK AND METHOD FOR MAKING THE SAME

BACKGROUND OF THE INVENTION

1. Field of the Invention

The invention relates to underground storage tanks generally and more particularly to a double walled underground storage tank in which the two walls are monolithically tied together to act as a composite structure.

2. Discussion of the Background

Underground storage tanks are used in a wide variety of locations to store materials underground. The materials are often harmful to the environment. Examples of such materials include gasoline and other petroleum products as well as toxic raw materials and waste from manufacturing processes. Because of the harmful nature of these materials, it is especially important to ensure that underground storage tanks containing such materials do not leak or release these materials into the environment.

Concern over this possibility has lead many governmental authorities to require secondary containment for tanks that store such materials. As used herein, secondary containment means that there are at least two barriers that prevent materials in the underground storage tank from being released into the surrounding soil. There are several ways in which secondary containment can be provided. For example, one way to provide secondary containment is to locate underground storage tanks in a vault. In this manner, should the tank itself break, material leaking from the tank will be contained by the vault. One of the most the most common methods for providing secondary containment is through the use of double walled underground storage tanks.

The first double walled underground storage tank prepared from corrosion resistant materials such as fiber reinforced plastic (FRP) was introduced by the Assignee of the present application in 1984. A diagram of this tank, which was referred to as the "Double Wall I" or "DWT I" tank, is shown in FIG. 6. The tank 6000 included an inner wall 6100 and an outer wall 6104 separated by a plurality of ribs 6102. An annular space 6101 was created between the inner wall 6100 and the outer wall 6104. This annular space 6101 was quite large, which increased the cost of the tank, especially when a monitoring fluid was used in the annular space 6101 to detects leaks. The volume of the annulus also imposed the requirement that it be filled at the installation site, rather than being filled at the factory. Additionally, the inner wall 6100 and the outer wall 6104 were not tied together in any fashion. This impacted the cost of the DWT I tank because each of the walls 6100, 6104 were required to be stronger that in the situation where the two walls could share strength locally as well as globally.

In order to provide the strength and safety of the Double Wall I tank at a reduced cost, Xerxes Corporation commercially introduced a new double wall tank referred to as the DWT II tank. This tank modified the original DWT I design by applying a faced plastic netting or spacer to the interior surface of the outer wall which is first formed wall in a female molded tank. This netting was "locked into place" with additional fiberglass material. Thereafter, an interior wall was formed, and bonded to the outer wall. The resulting tank was strong, durable, and environmentally sound but required considerable expertise to manufacture. Although the size of the annulus in the DWT II tank was greatly reduced as compared to the DWT I tank, it was still thicker than necessary for monitoring purposes. Ideally, only the minimum space necessary to provide for flow of liquid between the two walls should be provided.

An alternative approach to the DWT II tank is illustrated in U.S. Pat. No. 5,220,823. In this approach, a liquid pervious mat or felt is placed between the two walls. This material transmits load between the two walls. Because load is transmitted between walls locally as well as globally, each wall may be of reduced thickness. While this approach has independent advantages as set forth in that commonly assigned patent, it again presents an annulus of significant thickness and, particularly in the manufacture of a female molded tank, requires application of material to the interior of the tank and adherence of the material to the interior of the external wall, followed by application of the interior wall in a way that it adheres to the interior surface of the material. This generally requires use of additional adhesives, which complicates a process which already employs sprayed resin and catalyst.

A significant improvement to double walled underground storage tanks is described in U.S. Pat. No. 5,720,404 ("the '404 patent"), the contents of which are incorporated by reference herein. The '404 patent is also owned by Xerxes Corporation, the assignee of the present application. In the tank described in the '404 patent, the size of the annulus between the inner wall and outer wall is greatly reduced through the use of a thin plastic film, such as Mylar®. In addition to greatly reducing the size of the annulus through the use of Mylar®, the tank described in the '404 patent includes the additional advantage of having the inner wall and the outer wall tied directly together, rather than through an annular material such as was done in the tank described in the '823 patent. However, the tank described in the '404 patent required gutters to be installed in order to ensure communication between all areas of the annulus. The provision of gutters requires additional manufacturing steps, which leads to increased cost.

What is needed is a storage tank that can realize the benefits of the tank discussed in the '404 patent without requiring the provision of gutters.

SUMMARY OF THE INVENTION

The aforementioned need is met to a great extent by the present invention which provides an underground storage tank including an outer wall having integrally formed ribs, the ribs being closed off by a layer of material applied directly over the space defined created by the ribs and attached to the outer wall, a layer of plastic film or other annular material which facilitates liquid flow placed over portions of the outer wall between the ribs and extending past the shoulders of the ribs (as used herein, "shoulder" refers to the location where the ribs are joined to or integrally molded with the outer wall or where the outer wall curves to form the ribs) but not extending completely over the material covering the opening of the rib, and an inner wall formed over the annular material and attached to the portion of the material covering the opening of the rib that is not covered by the annular material. In this way, the inner wall is bonded to the outer wall through the material covering the opening of the rib. In preferred embodiments, the material covering the opening of the rib is applied before the outer wall has fully cured, and the inner wall is applied before the material covering the opening of the rib has fully cured, so as to form primary bonds and function as monolithically formed. At one or more locations along the circumference of the tank, a strip of annular material is placed over the material covering the rib, and a hole is formed in the material covering the opening of the rib such that communication between all annular areas of the tank (the annular areas between ribs formed by the annular material as well as the annular spaces defined by the ribs) is established. Functionally, this replaces the aforementioned gutters of the '404 patent tank and is much easier to perform.

BRIEF DESCRIPTION OF THE INVENTION

The aforementioned advantages and features of the present invention will be more readily understood with reference to the following detailed description and the accompanying drawings in which.

DETAILED DESCRIPTION

In the following detailed description, a plurality of specific details, such as dimensions and types of annular material, are provided in order to provide a through understanding of the present invention. The details discussed in connection with the preferred embodiments should not be understood to limit the present invention.

Figure 1:
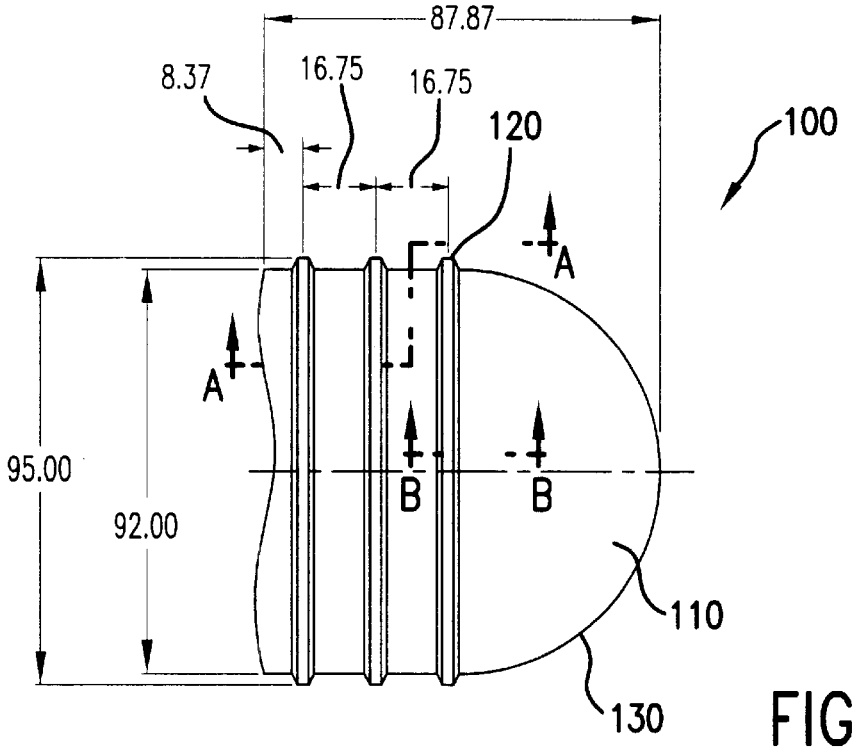
FIG. 1 is a side view of a portion of an underground storage tank according to the present invention.
Figure 2:
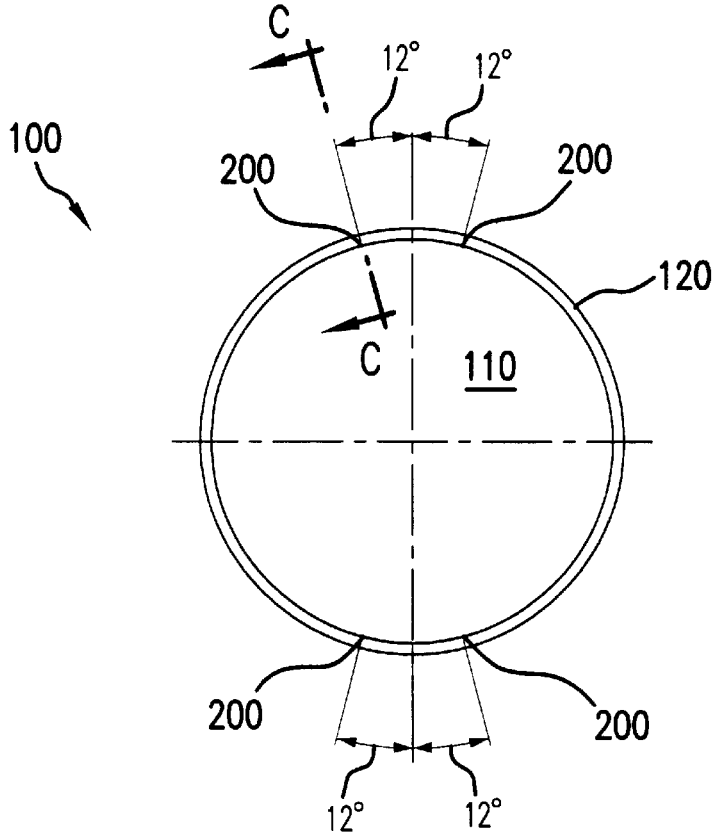
FIG. 2 is an end view of the storage tank of FIG. 1.

FIGS. 1 and 2 illustrate a portion of a tank 100, which includes an outer wall 110 and a plurality of ribs 120. In preferred embodiments, a female molding process is used to construct the tank 100. It is conventional for an underground storage tank that is manufactured using female molding technology to be manufactured in halves, with the halves joined together after each is manufactured. After the halves are joined, additional fittings, manways, risers, and the like may be added to the tank 100 by cutting the inner wall and/or the outer wall.

Figure 3:
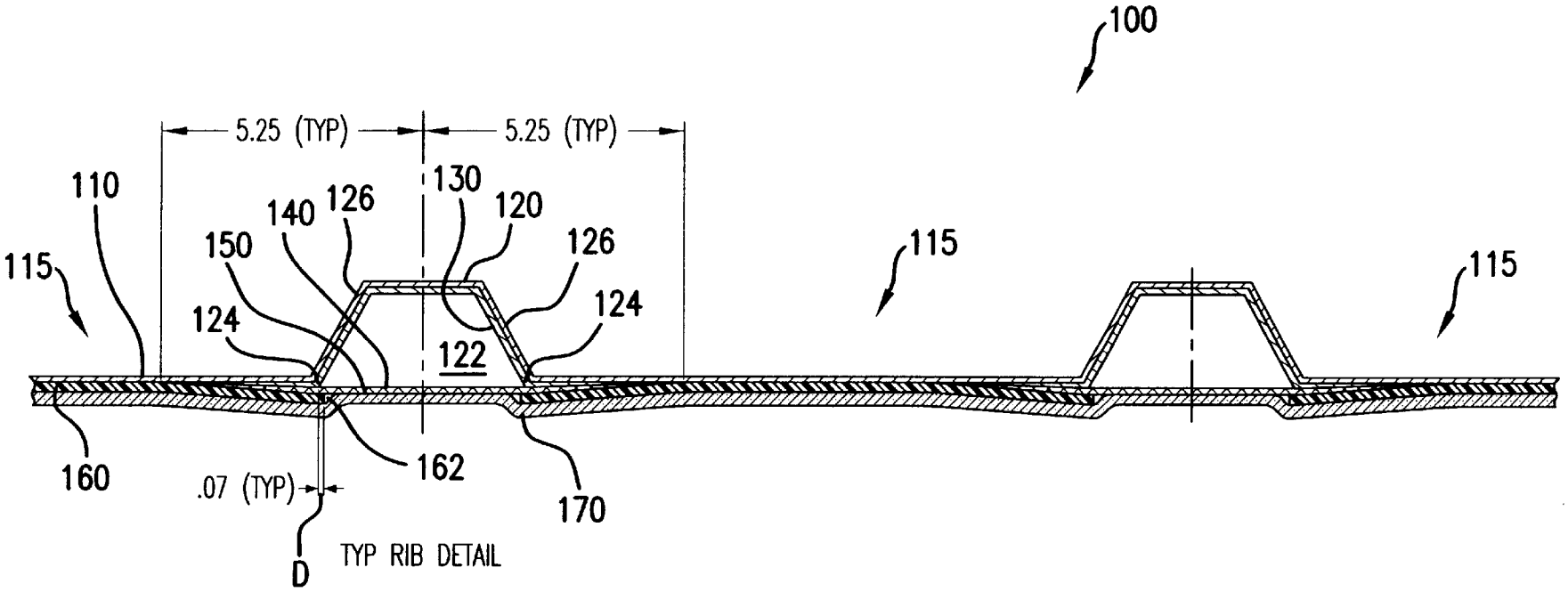
FIG. 3 is a cross-sectional view of a section of the tank of FIG. 1 taken along the line A—A of FIG. 1.

FIG. 3 is a cross-sectional view of a portion of the tank 100 taken along the line A—A of FIG. 1. The process of female molding a tank begins with the formation of the outer wall 110, which includes integral ribs 120. The outer wall 110 is formed by spraying up against a female mold a combination of chopped fiberglass and resin pre-polymer combined with a catalyst. The female mold (not shown in FIG. 3) is generally treated with a conventional release agent prior to the deposition of the materials in the mold. The resin cures in place, providing a hard, smooth-finished shell that is corrosion resistant and is substantially water tight. To ensure water tightness, and to provide for the next stage in processing, a mist coat of pure resin is applied to the interior of the outer wall 110. The mist coat as applied is tacky. The chopped fiberglass and resin employed in the construction of the tank is conventional. These materials, which are well known to those of skill in the art, will not be discussed in further detailed herein.

In order to provide extra strength for the rib 120, a second layer 130 of chopped fiberglass and resin is sprayed up in areas of the rib and surrounding areas. After this second layer 130 has been applied, and while the resin is still tacky, the opening (also referred to herein as an annular cavity) 122 defined by the rib 120 is closed off by providing a length of fabric 140, typically unidirectional, over the opening and spraying up another layer 150 of fiberglass chop and resin over the unidirectional fabric 140. Uni-directional fabric 140, which primarily functions to provide support for the layer 150, is preferable currently to other materials as the unidirectional fabric 140 easily bends to follow the curved contour of the outer wall 110 and ribs 120. The layer 150 is preferably sprayed up before the outer wall 110 and second layer 130 have fully cured so that primary bonds may be formed and composite system can function monolithically.

After the ribs have been closed off with the unidirectional fabric 140 and layer 150, an annular material 160 is placed over the outer wall 110 in areas 115 between the ribs 120. The annular material 160 extends up to and preferably past the shoulder 124 of each rib 120 such that the annular material 160 is present over at least a portion of the annular cavity 122 formed by the rib 120. In preferred embodiments, the distance D is approximately 0.07 inches. As will be discussed in further detail below, it is critical that the annular material 160 extend at least up to, and preferably a distance D, past the shoulder 124 in order to provide reliable secondary containment for the liquids in the tank itself.

The annular material 160 may be of a type through which fluids may flow, or may be of a type that allows fluid to flow along its surface. In preferred embodiments, the annular material 160 is a thin plastic film. Polyester films are preferred. An exemplary film of this type, which is preferably "crinkled," so as to promote the flow of fluids, is sold under the trademark Mylar®, which can be obtained from Qualis, Inc. of Henderson, Ky. The thickness of the annular film 160 is generally much less than 1 mil., and may be as thin as the material permits while retaining the ability to be applied to the interior of the tank. As is the case in the tank described in the '404 patent, the annular film 160 does not extend into the domes present on the ends of the tank 100, as will be discussed in further detail below in connection with FIG. 4.

After the annular film has been installed, the inner wall 170 is sprayed up over the annular film 160, and, in the areas of the rib 120, over the layer 150. In preferred embodiments, the inner wall 170 forms a chemical bond with the layer 150, which in turn is also chemically bonded to the outer wall 110. In highly preferred embodiments, the inner wall 170 is sprayed up before the layer 150 has fully cured so that a primary bond is formed. Thus, the inner wall 170 and outer wall 110 are chemically bonded to each other. This chemical bond increases the overall strength of the tank and helps prevent separation of the inner wall 170 and outer wall 110. Construction of this type provides for a monolithic composite, robust tank for a given amount of material.

Because the walls 126 of the rib 120 are slanted, and because the annular material 160 extends at least up to the shoulder 124 of the rib 120, secondary containment is achieved. In the context of a double walled storage tank, secondary containment refers to the fact that any line drawn at an angle normal to the inner wall 170 will intersect an annular space between the inner and outer walls, such as the annular space 115 provided by the annular material 160 and/or the space 122 under the rib 120, and therefore will intersect both the inner wall 170 and the outer wall 110. Because a small space 162 will be present when the annular material 160 extends just to the shoulder 124, it is sufficient for the annular material 160 to extend just to this point. However, it is preferable for the annular material 160 to extend past the shoulder 124 over the annular cavity 122. It should be noted that in the preferred embodiments, the provision of true secondary containment as well as a direct (preferably primary) chemical bond between inner and outer walls, is believed to be a particularly advantageous combination.

Figure 4:
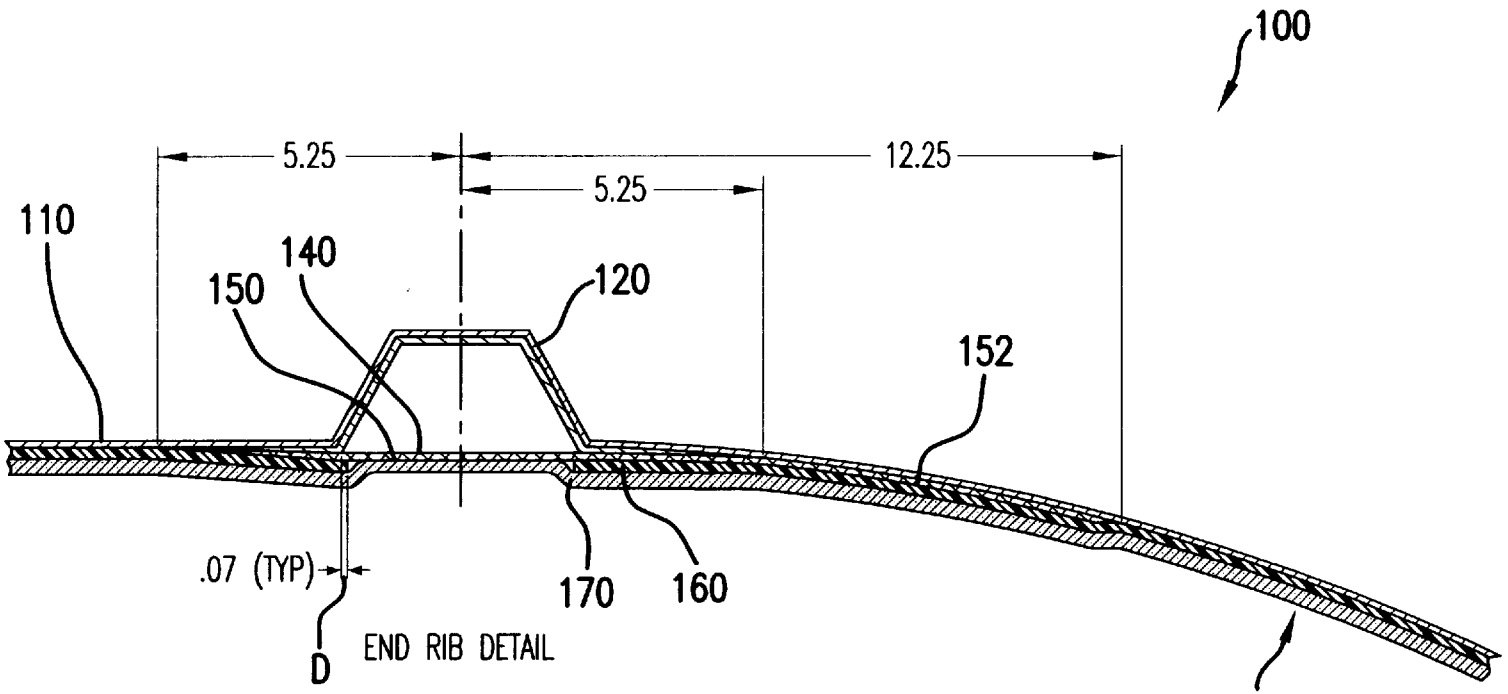
FIG. 4 is a cross-sectional view of a second section of the tank of FIG. 1 taken along the line B—B of FIG. 1.

FIG. 4 shows a portion of the tank 100 in an area near a dome 130. The construction is similar to that shown in FIG. 3. The major difference from the interior rib is that the unidirectional material 150 includes an extension 152 that extends partially around the dome 130. This is done to increase the strength of the tank in the domed area. In this embodiment, the annular material 160 shown in FIG. 4 does not extend all the way through the dome 130. Rather, the interior surface of the exterior wall 110 may be coated with wax and then with a wax alcohol formulation to act as a separating agent before the interior wall 170 is formed in this preferred embodiment. The interior wall 170 is then laid up over this separating agent such that the interior wall 170 remains separate from the exterior wall 110. An exemplary wax for this process is sold under the trademark X-08, which is available from the Rexco Company of California. An exemplary wax/alcohol formulation, also available from Rexco, is sold under the trademark Partall Paste #2.

It is possible to leave the annular spaces 115 between ribs 120 and the annular spaces 122 formed by the ribs 120 unconnected. However, this is undesirable when the annular space 115 and 122 are to be monitored, as separate monitors for each space would be required.

In order to address this issue, preferred embodiments provide fluid communication between all annular spaces 115 and 122, thereby creating a single, interconnected annular space. Preferably, the fluid communication is provided at multiple locations along the circumference of a tank such as locations 200 shown on the tank 100 of FIG. 2.

Figure 5:
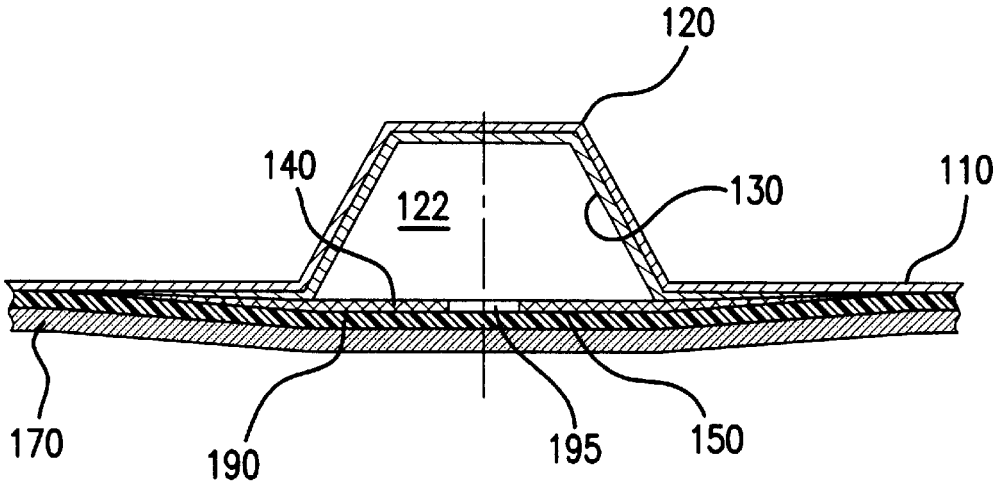
FIG. 5 is a cross-sectional view of a portion of the tank of FIG. 1, taken along the line C—C of FIG. 2.
Figure 6:
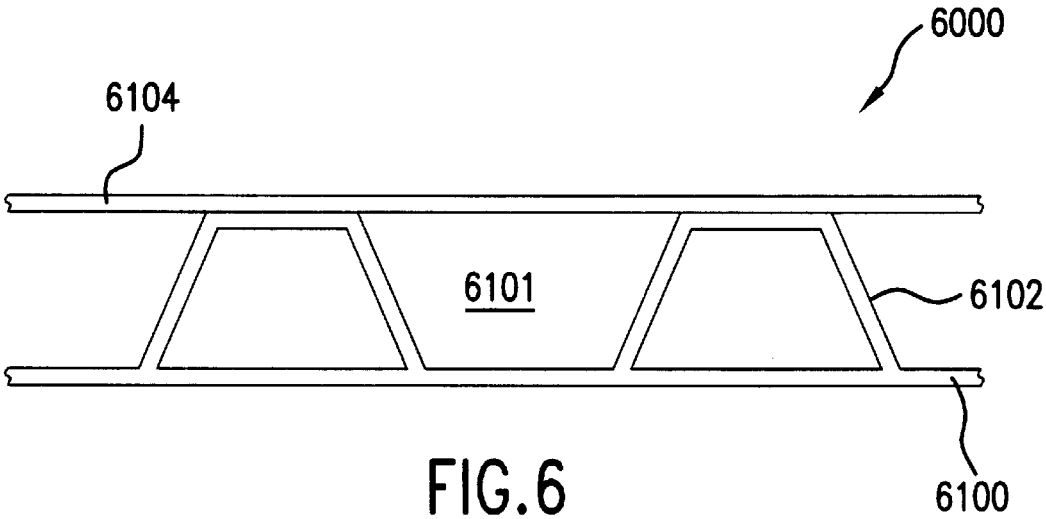
FIG.6 PRIOR ART
FIG. 6 is a cross-sectional view of a double wall underground storage tank according to one form of the prior art.

In preferred embodiments, the aforementioned fluid communications is achieved through the provision of flow through strips 190 as shown in FIG. 5. The flow through strips 190 may comprise the same material as the annular material 160. The strips abut the annular material 160 and thus are approximately as wide as the rib 120. The strips 190 extend from the first rib 120 to the last rib 120. Furthermore, a hole 195, preferably circular in shape and approximately one inch in diameter, is formed through the layers 140 and 150 such that fluid communication between the annular space 122 under the rib 120 and the strip 190 is achieved. Because the strip 190 extends from the first rib 120 to the last rib 120, a single annulus is created including each annular space 115 between ribs 120, each annular space 122 under each rib 120, and the annular space between the domed ends. Thus, a single monitor can be used to monitor the entire annulus.

As discussed above, the annular material 160 and the strips 190 comprise Mylar in preferred embodiments. However, other materials are suitable as well, including three dimensional distance fabrics sold under the marks Parabeam, Flo-core, Techno-Tex and Syncoloop. In the later embodiments, these materials may be adhered to both the inner and outer walls, which provides enhanced shear strength to such a tank.

As discussed above, female molding technology is used in preferred embodiments. However, those of skill in the art will recognize that male molding may also be used. Examples of male-molded tanks, from which manufacturing techniques may be adapted for the present invention, may be found in the following U.S. Pat. Nos. 5,224,621; 5,158,201; 4,739,659; 4,781,777; 4,871,078.

Obviously, numerous modifications and variations of the present invention are possible in light of the above teachings. It is therefore to be understood that within the scope of the appended claims, the invention may be practiced otherwise than as specifically described herein.

What is claimed is:

1. An underground storage tank comprising:

a first wall, the first wall having a plurality of ribs joined thereto, each rib forming a rib annular cavity, each rib having a pair of shoulders where the rib and first wall are joined;

a layer of rib covering material over each rib annular cavity, the material substantially covering the rib annular cavity;

a layer of annular material covering portions of the first wall between ribs, the annular material extending at least to the shoulders of the ribs;

at least one flow through strip, the flow through strip being positioned over portions of the rib annular cavity and being in fluid communication with the annular material such that fluid communication between all annular material between all ribs is established; and a second wall formed over the rib covering material, the flow through strip and the annular material, the second wall being in a closely spaced relationship to the first wall;

wherein the rib covering material over each rib has a hole formed therein in an area corresponding to the flow through strip such that fluid communication between each rib annular cavity and the flow through strip is established.

2. The tank of claim 1, wherein a diameter of the second wall is smaller than a diameter of the first wall and the second wall is located inside of the first wall.

3. The tank of claim 1, wherein the annular material is bonded to the first wall.

4. The tank of claim 1, wherein the annular material is bonded to the second wall.

5. The tank of claim 1, wherein the annular material is a thin plastic film.

6. The tank of claim 1, wherein the annular material is a distance fabric.

7. The tank of claim 1, wherein the annular material extends past the shoulders of the ribs such that it extends over a portion of the rib annular cavity.

8. The tank of claim 1, wherein the first wall and the second wall comprise fiberglass.

9. An underground storage tank comprising:

a first wall including a plurality of integrally formed ribs, each of the ribs defining a rib annular cavity, each rib including a pair of shoulders where the first wall curves to form the rib;

a layer of rib covering material over each rib annular cavity, the rib covering material being chemically bonded to the first wall, the rib covering material having a plurality of holes formed therein with at least one of the holes being in fluid communication with each rib annular cavity;

a layer of annular material over portions of the first wall between ribs, the annular material extending at least up to the shoulders of each rib, the annular material not covering at least a portion of the rib covering material;

at least one flow through strip in fluid communication with the plurality of holes in the rib covering material and the annular material between each rib; and a second wall formed over the at least one flow through strip, the annular material and the rib covering material, the second wall being chemically bonded to the rib covering material.

10. A method for making an underground storage tank comprising the steps of:

forming a first wall, the first wall having a plurality of ribs joined thereto, each rib forming a rib annular cavity, each rib having a pair of shoulders where the rib and first wall are joined;

covering substantially each rib annular cavity with a layer of rib covering material;

covering portions of the first wall between ribs with annular material, the annular material extending at least to the shoulders of the ribs;

positioning at least one flow through strip over portions of the rib annular cavity of each rib such that the flow through strip is in fluid communication with the annular material and such that fluid communication between all annular material between all ribs is established;

forming a hole in the rib covering material over each rib in an area corresponding to the flow through strip such that fluid communication between each rib annular cavity and the flow through strip is established; and forming a second wall formed over the rib covering material and the annular material, the second wall being in a closely spaced relationship to the first wall.

11. The method of claim 10, wherein the second wall is formed smaller than the first wall and inside of the first wall.

12. The method of claim 11, further comprising the step of bonding the annular material to the first wall.

13. The method of claim 11, further comprising the step of bonding the annular material to the second wall.

14. The method of claim 11, wherein the annular material is a thin plastic film.

15. The method of claim 11, wherein the annular material is a distance fabric.

16. The method of claim 10, wherein the annular material extends past the shoulders of the ribs such that it extends over a portion of the rib annular cavity.

17. The method of claim 16, wherein the first wall and the second wall are formed from fiberglass.

18. A method for making a storage tank comprising the steps of:

forming a first wall including a plurality of integrally formed ribs in a female mold, each of the ribs defining a rib annular cavity, each rib including a pair of shoulders where the first wall curves to form the rib;

covering each rib annular cavity with a layer of rib covering material, the rib covering material being chemically bonded to the first wall;

forming a plurality of holes in the rib covering material, at least one hole being formed over each rib annular cavity such that the hole is in fluid communication with the rib annular cavity;

positioning a layer of annular material over portions of the first wall between ribs, the annular material extending at least up to the shoulders of each rib, the annular material not covering at least a portion of the rib covering material;

providing at least one flow through strip in fluid communication with the plurality of holes in the rib covering material and the annular material between each rib; and forming a second wall formed over the at least one flow through strip, the annular material and the rib covering material, the second wall being chemically bonded to the rib covering material.

* * * * *